US010505300B2

(12) United States Patent
Chen

(10) Patent No.: US 10,505,300 B2
(45) Date of Patent: Dec. 10, 2019

(54) ELECTRICAL CONNECTOR HAVING A BLIND-MATE AIDER

(71) Applicant: FOXCONN INTERCONNECT TECHNOLOGY LIMITED, Grand Cayman (KY)

(72) Inventor: Ming-Ching Chen, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/989,195

(22) Filed: May 25, 2018

(65) Prior Publication Data

US 2018/0342823 A1 Nov. 29, 2018

(30) Foreign Application Priority Data

May 26, 2017 (CN) ..... 2017 1 0382949

(51) Int. Cl.

| | |
|---|---|
| ***H01R 12/50*** | (2011.01) |
| ***H01R 12/70*** | (2011.01) |
| *H01R 13/506* | (2006.01) |
| *H01R 12/73* | (2011.01) |
| *H01R 12/71* | (2011.01) |

(52) U.S. Cl.

CPC ..... *H01R 12/7005* (2013.01); *H01R 12/716* (2013.01); *H01R 12/73* (2013.01); *H01R 13/506* (2013.01)

(58) Field of Classification Search

CPC .. H01R 12/7005; H01R 12/716; H01R 12/73; H01R 13/506

USPC ..... 439/74, 607.36

See application file for complete search history.

(56) References Cited

U.S. PATENT DOCUMENTS

| | | | | |
|---|---|---|---|---|
| 6,503,101 | B1 * | 1/2003 | Yu | H01R 13/6597 439/607.36 |
| 8,888,506 | B2 * | 11/2014 | Nishimura | H01R 12/7082 439/74 |
| 8,986,027 | B2 * | 3/2015 | Nishimura | H01R 12/707 439/181 |
| 9,331,410 | B2 | 5/2016 | Obikane et al. | |
| 9,356,371 | B2 | 5/2016 | Goto et al. | |
| 2005/0032400 | A1 * | 2/2005 | Zhang | H01R 13/41 439/74 |
| 2005/0042924 | A1 * | 2/2005 | Zhang | H01R 13/6582 439/607.36 |
| 2006/0063432 | A1 * | 3/2006 | Chen | H01R 13/658 439/607.36 |
| 2006/0276061 | A1 * | 12/2006 | Koguchi | H01R 12/725 439/74 |
| 2008/0207014 | A1 * | 8/2008 | Takeuchi | H01R 13/6275 439/74 |
| 2008/0305657 | A1 * | 12/2008 | Midorikawa | H01R 4/028 439/74 |

(Continued)

*Primary Examiner* — Abdullah A Riyami
*Assistant Examiner* — Nelson R. Burgos-Guntin
(74) *Attorney, Agent, or Firm* — Wei Te Chung; Ming Chieh Chang

(57) ABSTRACT

An electrical connector includes: an insulative housing having a peripheral side wall, the peripheral side wall surrounding a receiving space that opens in an upward direction; plural contacts secured to the insulative housing; and an aider mounted to and extending upward beyond the peripheral side wall.

20 Claims, 8 Drawing Sheets

(56) References Cited

U.S. PATENT DOCUMENTS

| | | | | |
|---|---|---|---|---|
| 2009/0061655 | A1* | 3/2009 | Miyazaki | H01R 12/57 439/74 |
| 2010/0068900 | A1* | 3/2010 | Wu | H01R 12/716 439/74 |
| 2011/0263140 | A1* | 10/2011 | Sato | H01R 12/7052 439/74 |
| 2013/0012039 | A1* | 1/2013 | Nose | H01R 12/716 439/74 |
| 2015/0079816 | A1* | 3/2015 | Suzuki | H01R 12/716 439/74 |
| 2015/0140840 | A1* | 5/2015 | Nishimura | H01R 12/79 439/74 |
| 2015/0140841 | A1* | 5/2015 | Watanabe | H01R 12/7011 439/74 |
| 2015/0207248 | A1* | 7/2015 | Takenaga | H01R 12/716 439/74 |
| 2016/0190719 | A1* | 6/2016 | Brzezinski | H01R 12/73 439/74 |
| 2017/0033505 | A1* | 2/2017 | Ozeki | H01R 12/716 |
| 2018/0076549 | A1 | 3/2018 | Chen | |
| 2018/0342823 | A1* | 11/2018 | Chen | H01R 12/7005 |
| 2018/0358729 | A1* | 12/2018 | Chen | H01R 13/20 |

* cited by examiner

ELECTRICAL CONNECTOR HAVING A BLIND-MATE AIDER

BACKGROUND OF THE INVENTION

1. Field of the Invention

The present invention relates to an electrical connector having a blind-mate aider movably mounted to a peripheral side wall of an insulative housing thereof.

2. Description of Related Art

U.S. Pat. No. 9,356,371 discloses a connector including an insulative housing having a peripheral side wall and an island and plural wide and narrow terminals that can be connected respectively to power lines and signal lines. The side wall has a chamfered mating surface for guiding purpose during mating with a complementary connector.

SUMMARY OF THE INVENTION

An electrical connector comprises: an insulative housing having a peripheral side wall, the peripheral side wall surrounding a receiving space that opens in an upward direction; a plurality of contacts secured to the insulative housing; and an aider mounted to and extending upward beyond the peripheral side wall.

DETAILED DESCRIPTION OF THE PREFERRED EMBODIMENT

Figure 1:
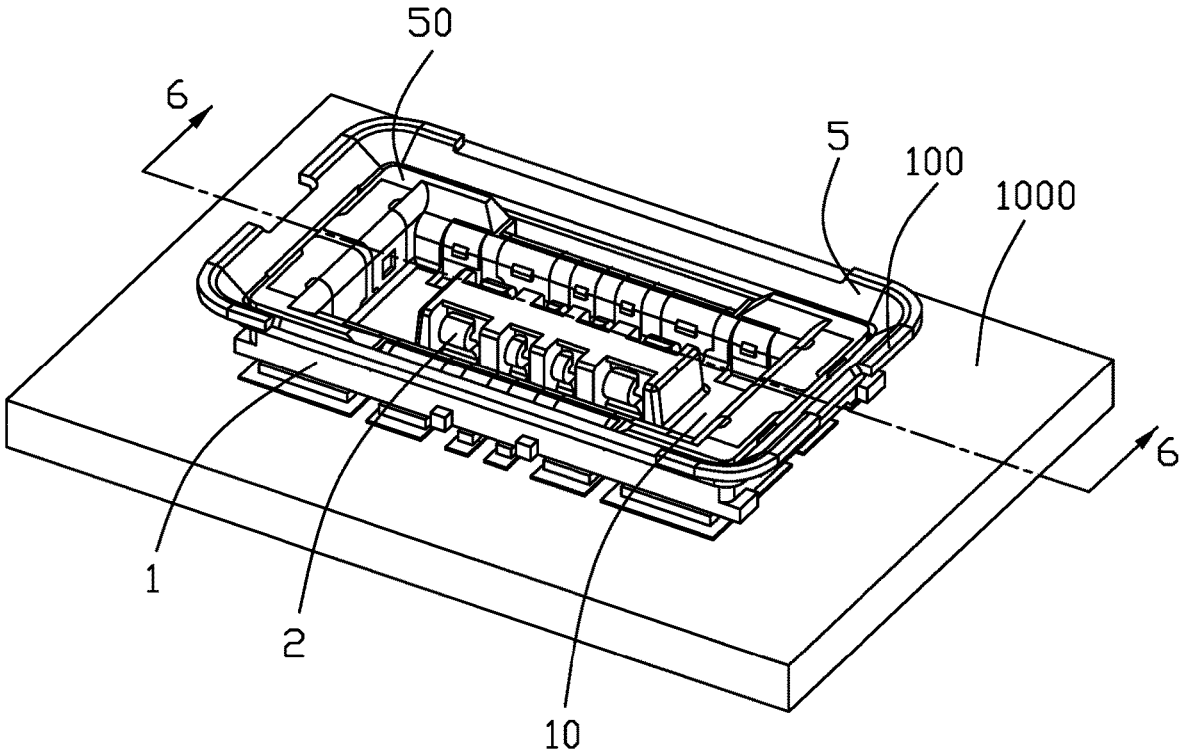
FIG. 1 is a perspective view of a receptacle connector in accordance with the present invention mounted on a printed circuit board.
Figure 2:
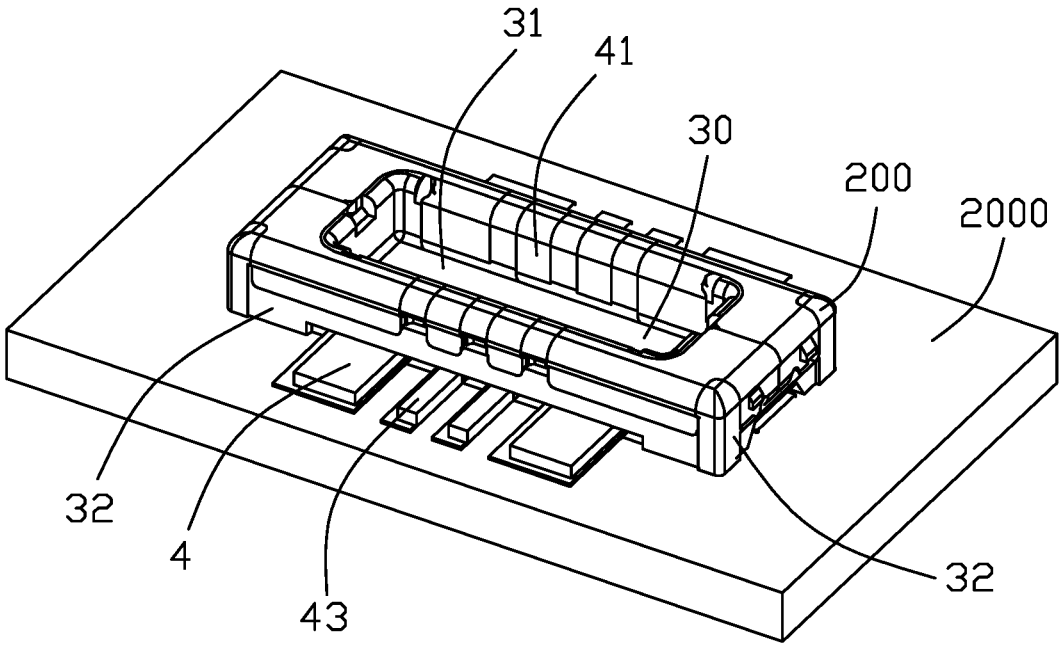
FIG. 2 is a perspective view of a complementary plug connector mounted on another printed circuit board for mating with the receptacle connector.
Figure 3:
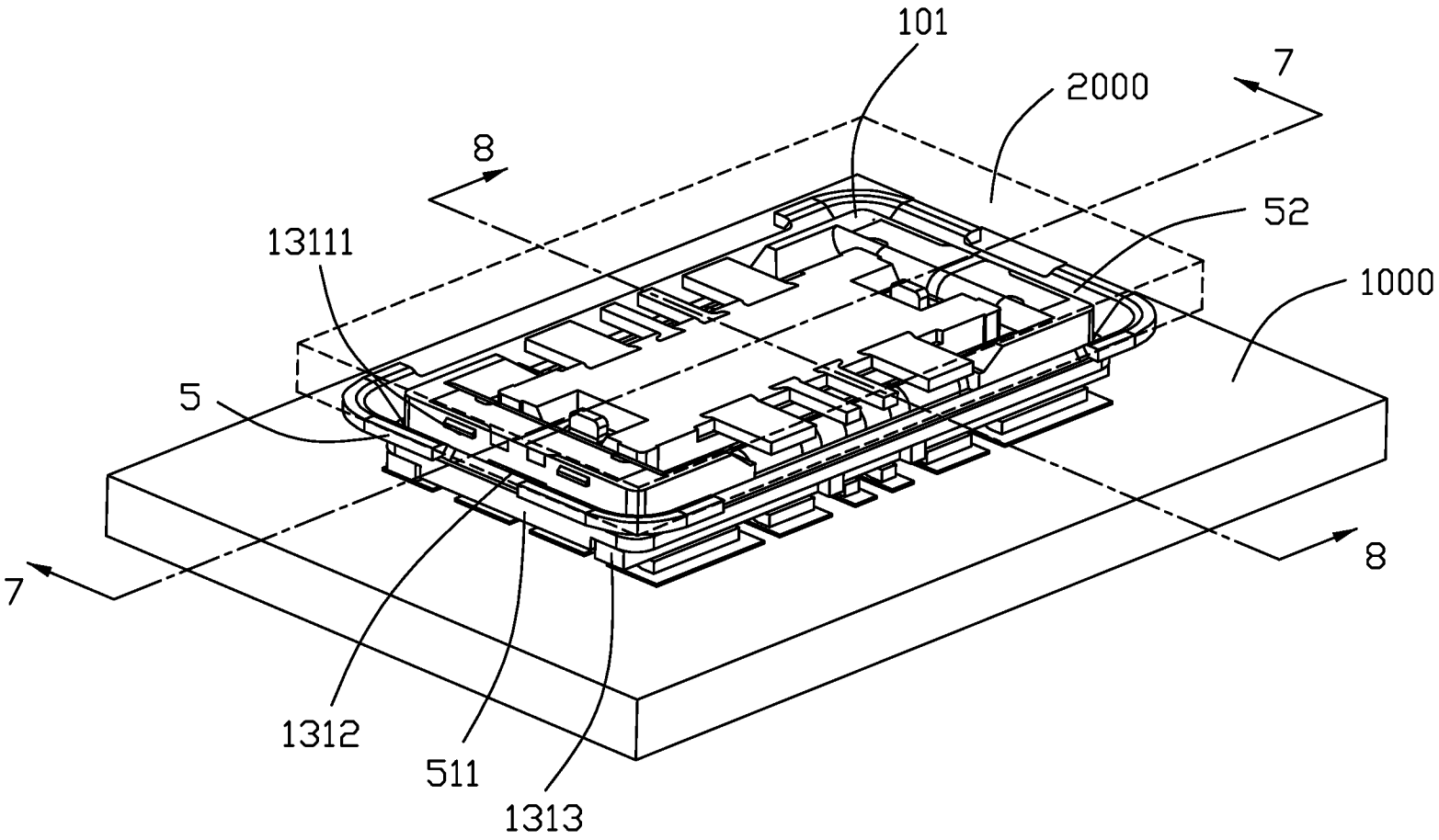
FIG. 3 is perspective view showing the receptacle connector is mated with the complementary plug connector.
Figure 4:
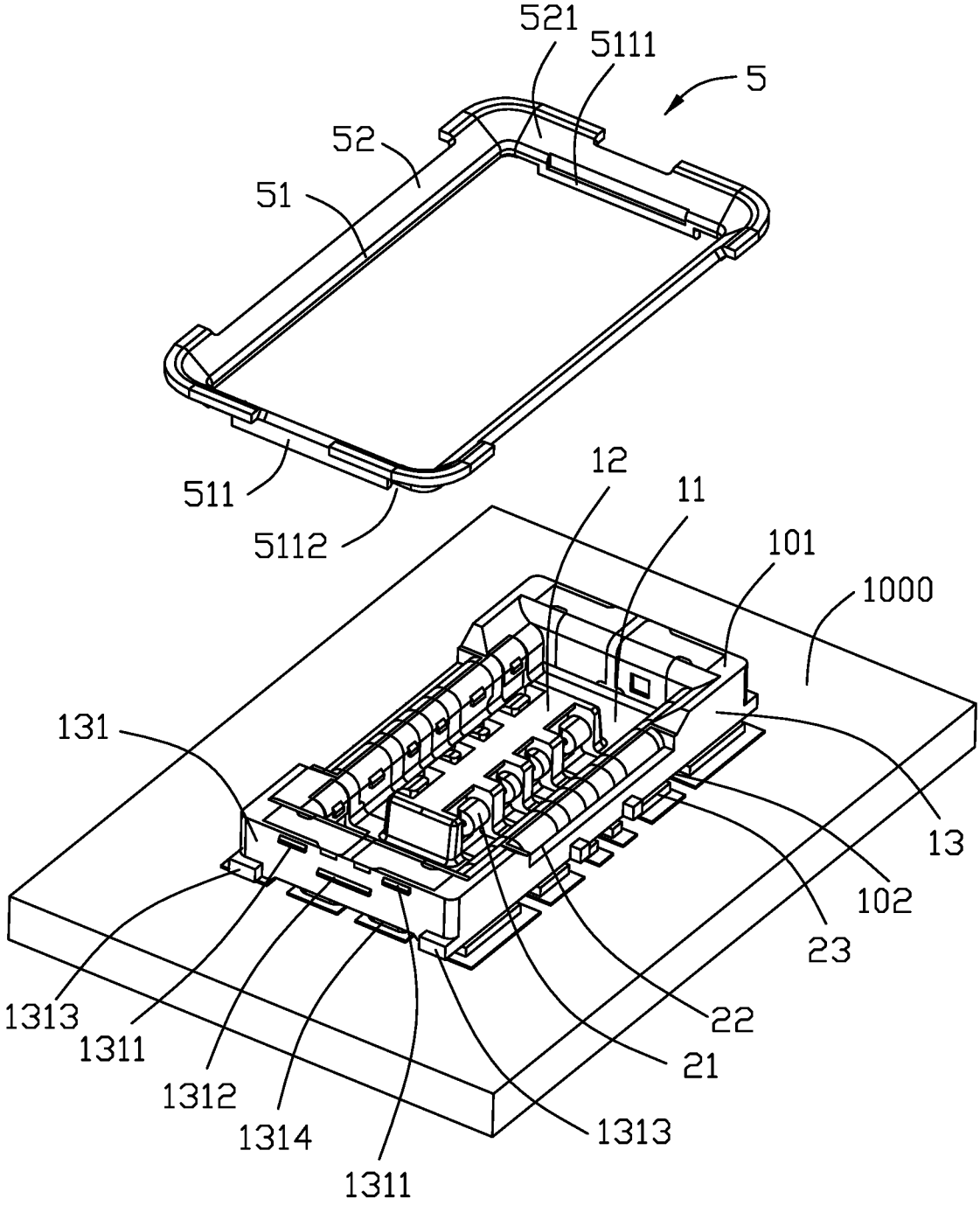
FIG. 4 is an exploded view of the electrical connector.

Referring to FIGS. 1-4, an electrical connector 100, in the form of a receptacle connector, mounted on a printed circuit board (PCB) 1000 is to be mated with a complementary plug connector 200 mounted on another PCB 2000.

Figure 5:
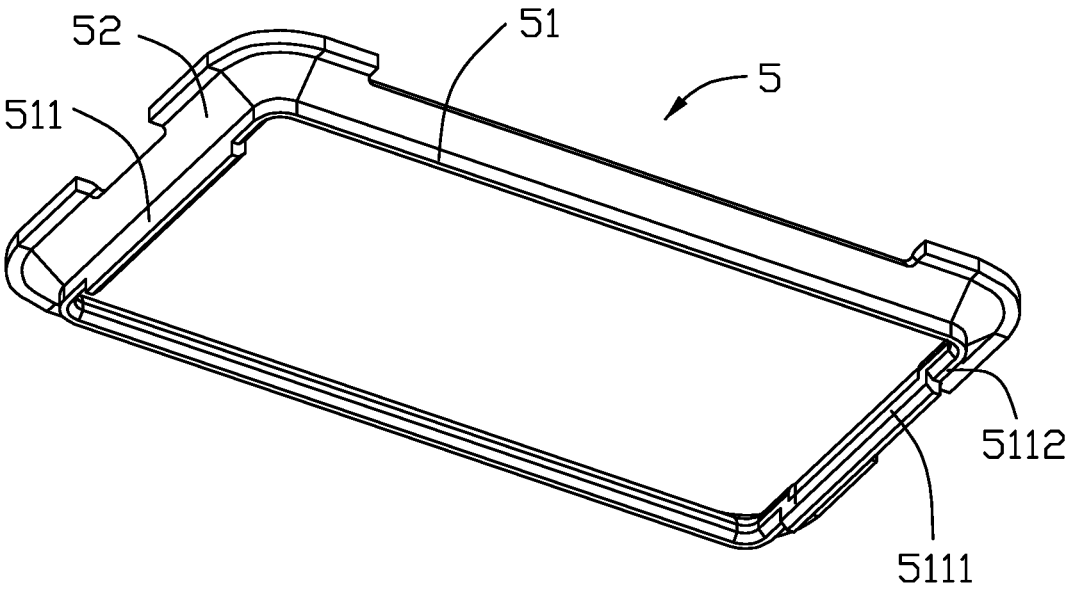
FIG. 5 is a perspective view of an aider of the receptacle connector.
Figure 6:
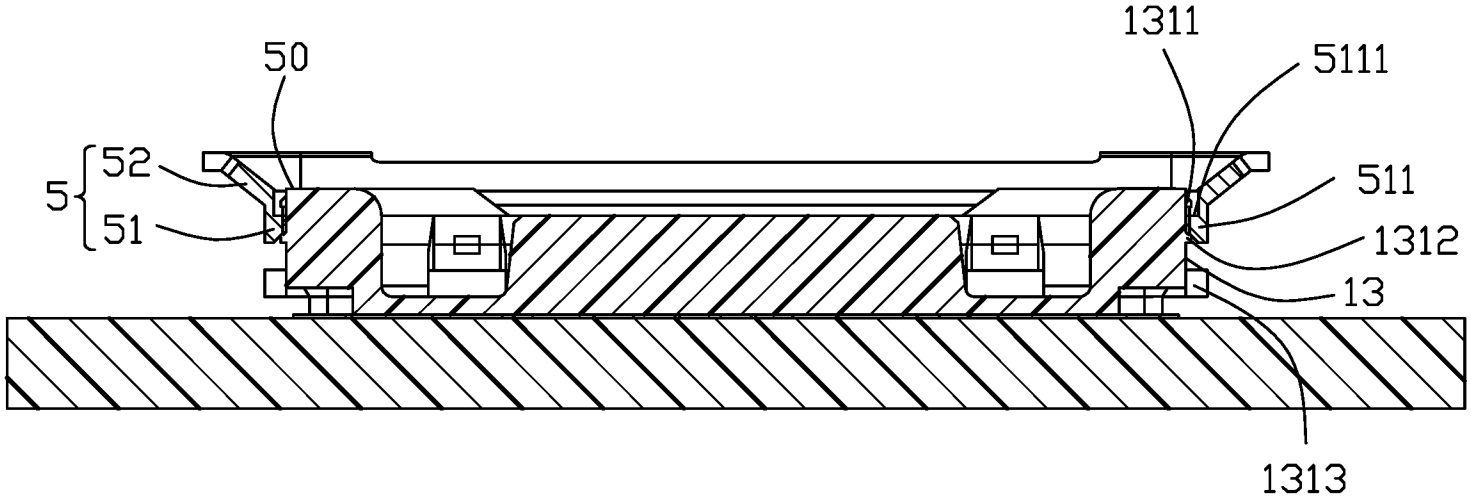
FIG. 6 is a cross-sectional view of the receptacle connector taken along line A-A in FIG. 1.
Figure 7:
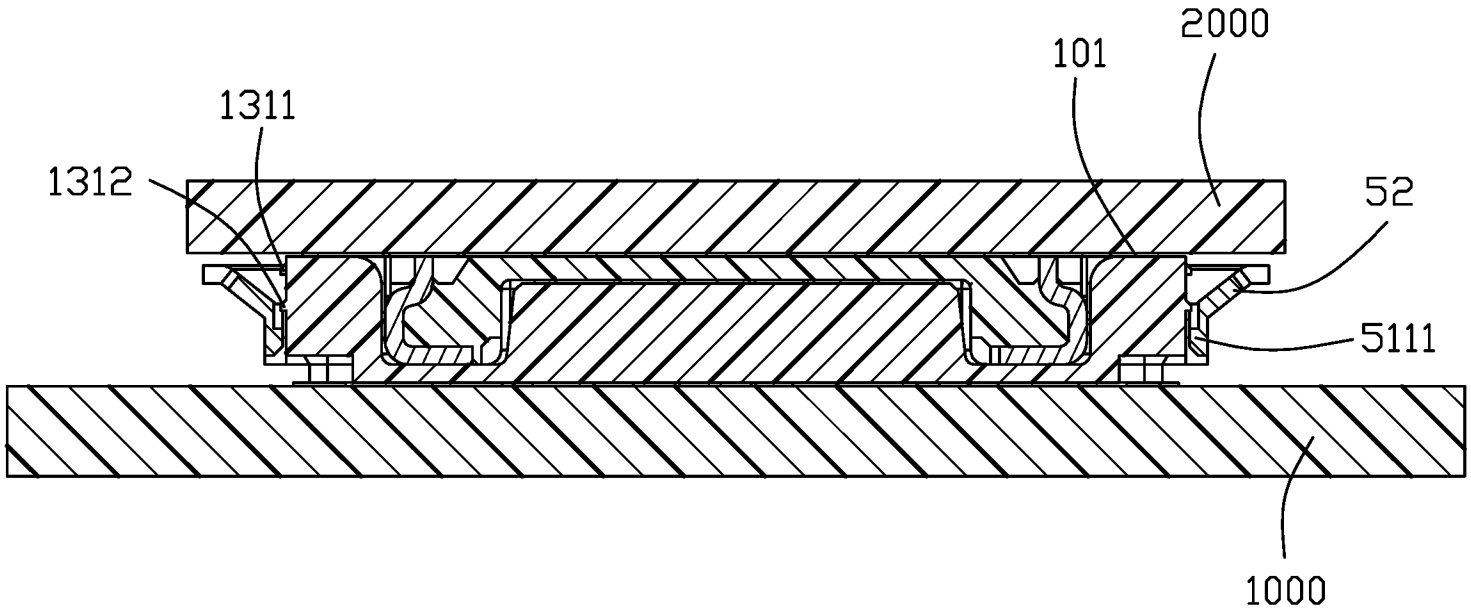
FIG. 7 is a cross-sectional view of the receptacle connector taken along line B-B in FIG. 3.
Figure 8:
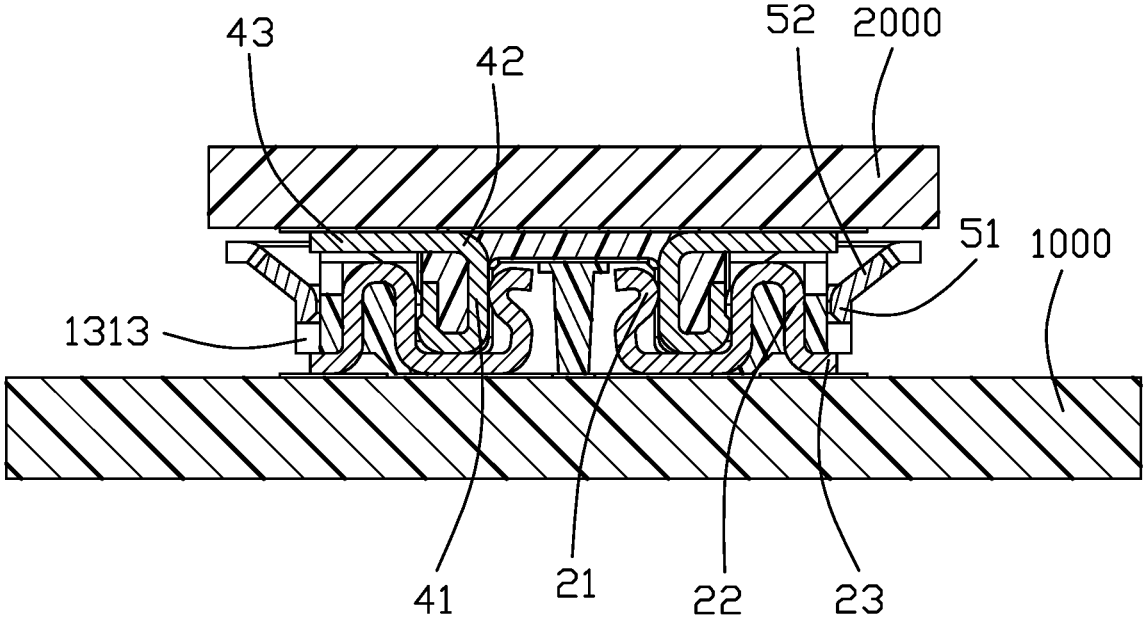
FIG. 8 is a cross-sectional view of the receptacle connector taken along line C-C in FIG. 3.

Referring in conjunction with FIGS. 5-8, the receptacle connector 100 includes an insulative housing 1, and a plurality of contacts 2 secured to the insulative housing 1, and an aider 5 mounted to the insulative housing 1. The receptacle connector 100 may further include a pair of holding members secured to two opposite ends of the insulative housing 1 as is well known in this art. The insulative housing 1 has a bottom 11, an island 12, and a peripheral side wall 13 which is essentially composed of the long walls and the short walls extending along the longitudinal direction and the transverse direction, together defining a receiving space 10 that opens in an upward direction away from the PCB 1000. The insulative housing 1 has opposite top and bottom end faces 101 and 102. Each contact 2 has a contacting portion 21, a securing portion 22, and a soldering portion 23.

Referring to FIGS. 1-5, the plug connector 200 includes an insulative housing 3 and a plurality of contacts 4 secured to the insulative housing 3. The insulative housing 3 has a bottom 31 and a peripheral side wall 32, together defining a receiving space 30. Each contact 4 has a contacting portion 41, a securing portion 42, and a soldering portion 43.

The aider 5 is mounted to and extends upward beyond the top end face 101 of the peripheral side wall 13 to form an adapting room 50. That is, the adapting room 50 is enlarged to effectuate a better blind-mate.

The aider 5 includes a lower engaging portion 51 and an upper guiding portion 52 having a guiding surface 521. The aider 5 is generally of an annular frame, continuous or not, and may be metallic or plastic or other suitable materials with suitable strength thereof. The aider 5 is restrained or held to an outer surface 131 of the peripheral side wall 13. The upper guiding portion 52 is flaring outward and upward. The peripheral side wall 13 has one or more upper protrusions 1311 and one or more lower protrusions 1312 at each of two opposite ends thereof. The lower engaging portion 51 includes a pair of protrusions 511 each having a respective latch 5111 to be confined between associated upper and lower protrusions 1311 and 1312. This position of the latch 5111 between associated upper and lower protrusions 1311 and 1312 is the initial position prior to mating the plug connector 200 with the receptacle connector 100. In this embodiment, each protrusion 511 forms a slot (not labeled) to receive the corresponding upper protrusion 1311 or lower protrusion 1312 therein, depending upon which position of the aider 5 with regard to the housing 3. The aider 5 assists in guiding the plug connector 200 to mate with the receptacle connector 100. During blind-mating to successful mating, the PCB 2000 on the plug connector side moves the upper guiding portion 52 of the aider 5 so that the latches 5111 of the aider 5 move downward past the lower protrusions 1312 of the peripheral side wall 13. At this time, the aider 5 completes its intended function of guiding and give way to normal mating of the two connectors where the upper guiding portion 52 does not extend beyond the top end face 101 of the peripheral side wall 13.

The peripheral side wall 13 may have one or more stoppers 1313 for arresting a downward movement of the aider 5 in order to prevent the pair of protrusions 511 of the lower engaging portion 51 from contacting or damaging the PCB 1000. Correspondingly, the lower engaging portion 51 may have a pair of recesses 5112 beside the protrusion 511 to engage the stoppers 1313; the protrusion 511 is accommodated in a space 1314 between a pair of stoppers 1313 without interfering the PCB 1000. Notably, during mating, the aider 5 will be automatically dropped from the upper initial position to the lower final position either by gravity or inherent elasticity thereof once the latch 5111 passes the corresponding lower protrusion 1312. Understandably, the upper edge of the upper guiding portion 52 may be equipped with an insulative coating for avoiding improperly electrically connecting the conductive traces on the PCB 2000 during the mating process.

What is claimed is:

1. An electrical connector comprising:

an insulative housing having a peripheral side wall, the peripheral side wall surrounding a receiving space that opens in an upward direction;

a plurality of contacts secured to the insulative housing; and an aider mounted to and extending upward beyond the peripheral side wall, the aider being movable relative to the insulative housing during mating with a complementary connector to a position where a top portion of the aider is lower than a top end face of the insulative housing.

2. The electrical connector as claimed in claim 1, wherein the insulative housing comprises an island in the receiving space.

3. The electrical connector as claimed in claim 1, wherein the aider has an upper guiding portion and a lower engaging portion, the lower engaging portion having a pair of latches, and the peripheral side wall has a respective upper and lower protrusions at each of two opposite ends thereof for holding a corresponding latch therebetween.

4. The electrical connector as claimed in claim 1, wherein the peripheral side wall has a stopper for arresting a downward movement of the aider.

5. The electrical connector as claimed in claim 1, wherein the aider is metallic or plastic.

6. The electrical connector as claimed in claim 1, further comprising a pair of holding members secured to two opposite ends of the insulative housing.

7. An electrical connector assembly for mating with another electrical connector assembly, comprising:

a printed circuit board;

an electrical connector mounted upon the printed circuit board and including an insulative housing including a peripheral side wall having a pair of long walls extending along a longitudinal direction and spaced from each other in a transverse direction perpendicular to said longitudinal direction, and a pair of short walls extending along the transverse direction and spaced from each other in the longitudinal direction;

a plurality of contacts disposed in the housing;

an aider defining a frame configuration and attached upon an exterior side of the peripheral side wall; wherein the aider defines an upper guiding portion in a divergent manner and is adapted to be moved from an initial upper position to a final lower position in a vertical direction perpendicular to both the longitudinal direction and the transverse direction during mating with said another electrical connector assembly.

8. The electrical connector assembly as claimed in claim 7, wherein the peripheral side wall forms an upper protrusion and a lower protrusion to maintain the aider in the initial upper position before mating with said another electrical connector assembly.

9. The electrical connector assembly as claimed in claim 8, wherein said aider includes a latch located between the upper protrusion and the lower protrusion before mating with said another electrical connector assembly.

10. The electrical connector assembly as claimed in claim 9, wherein the aider forms a slot above the latch to receive either the upper protrusion or the lower protrusion, depending upon which one of said initial upper position and the final lower position of the aider with regard to the housing.

11. The electrical connector assembly as claimed in claim 10, wherein said latch is located at a lower edge of the aider opposite to the upper guiding portion in the vertical direction.

12. The electrical connector assembly as claimed in claim 7, wherein said upper guiding portion is of a frame configuration with four round corners.

13. The electrical connector assembly as claimed in claim 7, wherein said housing forms a plurality of stoppers for prohibiting the aider from downwardly contacting the printed circuit board.

14. An electrical connector for mounting upon a printed circuit board comprising:

an insulative housing including a peripheral side wall having a pair of long walls extending along a longitudinal direction and spaced from each other in a transverse direction perpendicular to said longitudinal direction, and a pair of short walls extending along the transverse direction and spaced from each other in the longitudinal direction;

a plurality of contacts disposed in the housing;

an aider defining a frame configuration and attached upon an exterior side of the peripheral side wall; wherein the aider defines an upper guiding portion in a divergent manner and is adapted to be moved from an initial upper position to a final lower position in a vertical direction perpendicular to both the longitudinal direction and the transverse direction during mating with another electrical connector.

15. The electrical connector as claimed in claim 14, wherein the peripheral side wall forms an upper protrusion and a lower protrusion to maintain the aider in the initial upper position before mating with said another electrical connector.

16. The electrical connector as claimed in claim 15, wherein said aider includes a latch located between the upper protrusion and the lower protrusion before mating with said another electrical connector assembly.

17. The electrical connector as claimed in claim 16, wherein the aider forms a slot above the latch to receive either the upper protrusion or the lower protrusion, depending upon which one of said initial upper position and the final lower position of the aider with regard to the housing.

18. The electrical connector as claimed in claim 16, wherein said latch is located at a lower edge of the aider opposite to the upper guiding portion in the vertical direction.

19. The electrical connector as claimed in claim 14, wherein said upper guiding portion is of a frame configuration with four round corners.

20. The electrical connector as claimed in claim 14, wherein said housing forms a plurality of stoppers for prohibiting the aider from downwardly contacting a printed circuit board on which the electrical connector is mounted.

* * * * *